US010697691B2

(12) United States Patent
Kerner et al.

(10) Patent No.: US 10,697,691 B2
(45) Date of Patent: Jun. 30, 2020

(54) DOMESTIC REFRIGERATION APPLIANCE COMPRISING A COMPRESSOR HAVING COMPRESSOR FEET

(71) Applicant: BSH HAUSGERÄTE GMBH, München (DE)

(72) Inventors: Stefan Kerner, Aislingen (DE); Waldemar Reber, Heidenheim (DE); Werner Schmid, Nördlingen (DE); Udo Schuster, Bachhagel (DE)

(73) Assignee: BSH Hausgeräte GmbH, Munich (DE)

( * ) Notice: Subject to any disclaimer, the term of this patent is extended or adjusted under 35 U.S.C. 154(b) by 82 days.

(21) Appl. No.: 15/120,278

(22) PCT Filed: Mar. 26, 2015

(86) PCT No.: PCT/EP2015/056620

§ 371 (c)(1),
(2) Date: Aug. 19, 2016

(87) PCT Pub. No.: WO2015/155025

PCT Pub. Date: Oct. 15, 2015

(65) Prior Publication Data

US 2017/0059231 A1 Mar. 2, 2017

(30) Foreign Application Priority Data

Apr. 8, 2014 (DE) ..... 10 2014 206 718

(51) Int. Cl.
*F25D 23/00* (2006.01)
*F04B 39/00* (2006.01)
(Continued)

(52) U.S. Cl.
CPC ..... *F25D 23/006* (2013.01); *F04B 39/0044* (2013.01); *F04B 53/003* (2013.01);
(Continued)

(58) Field of Classification Search
CPC ..... F25D 23/006; F25B 31/00; F16B 17/00
See application file for complete search history.

(56) References Cited

U.S. PATENT DOCUMENTS 2,849,201 A * 8/1958 Schelgunov ..... A47B 91/00 16/42 R
4,471,633 A * 9/1984 Tinsler ..... F25D 23/006 62/277
(Continued)

FOREIGN PATENT DOCUMENTS

CN 1157037 A 8/1997
CN 102947656 A 2/2013
(Continued)

OTHER PUBLICATIONS

English Translation of JP2012-122664.*
(Continued)

*Primary Examiner* — David J Teitelbaum
(74) *Attorney, Agent, or Firm* — Nixon & Vanderhye, P.C.

(57) ABSTRACT

The invention relates to a domestic appliance, in particular a domestic refrigeration appliance, comprising a compressor having compressor feet, which is supported on a support rail by way of elastic damping bodies that are arranged in openings of the compressor feet, and which is held thereto by way of the damping bodies by bottom-penetrating retaining tabs having securing portions engaging the damping bodies from behind. In order to allow a simple and economical installation of the compressor, which nonetheless results in a permanently secure retention of the compressor, end portions of the retaining tabs extending beyond the damping bodies, according to the invention, have insertion means, which are designed in such a way that the compressor is mounted, or can be mounted, without a plastic deformation of the retaining tabs.

18 Claims, 5 Drawing Sheets

Figure 1:
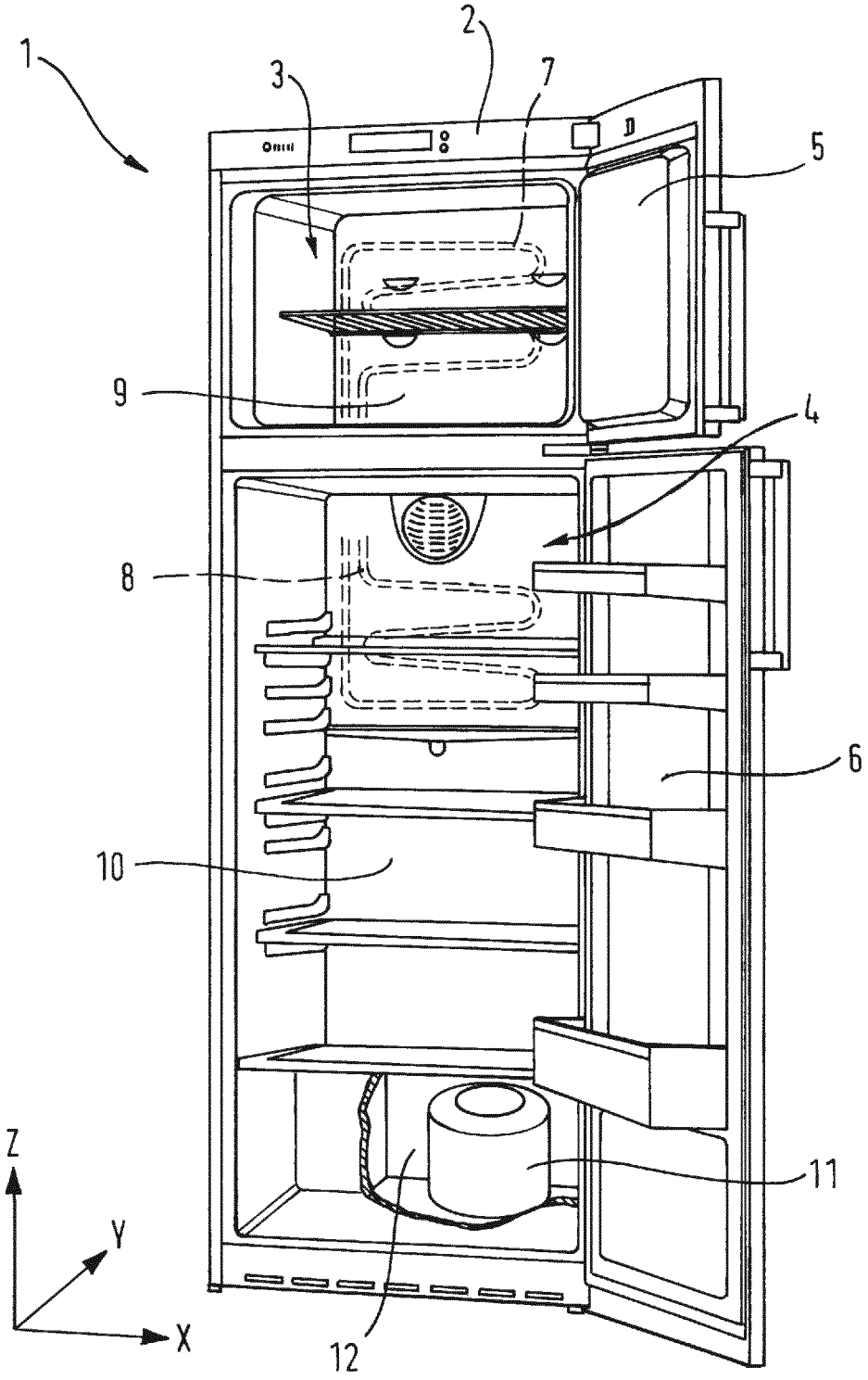

(51) Int. Cl.

| | |
|---|---|
| ***F04B 53/00*** | (2006.01) |
| ***F25B 31/00*** | (2006.01) |
| ***F25D 11/02*** | (2006.01) |

(52) U.S. Cl.

CPC ..... *F25B 31/00* (2013.01); *F25D 11/02* (2013.01); *F25B 2500/13* (2013.01)

(56) References Cited

U.S. PATENT DOCUMENTS

| | | | | |
|---|---|---|---|---|
| 4,920,696 | A * | 5/1990 | Mawby | F25D 23/006 248/674 |
| 5,040,953 | A * | 8/1991 | Tinsler | F16F 1/377 248/632 |
| 2014/0112811 | A1 * | 4/2014 | Fang | F04B 39/0061 417/437 |

FOREIGN PATENT DOCUMENTS

| | | | |
|---|---|---|---|
| EP | 1 557 623 | A1 | 7/2005 |
| FR | 2 643 446 | | 8/1990 |
| JP | S57-108062 | | 7/1982 |
| JP | S58-76085 | | 5/1983 |
| JP | S62-213677 | | 9/1987 |
| JP | 2012-122664 | | 6/2012 |
| JP | 5414657 | B2 | 2/2014 |
| SU | 427213 | A | 11/1974 |

OTHER PUBLICATIONS

International Search Report for PCT/EP2015/056620 dated Jun. 26, 2015, 2 pages.

Written Opinion of the ISA (foreign-language) for PCT/EP2015/056620 dated Jun. 26, 2015, 5 pages.

* cited by examiner

DOMESTIC REFRIGERATION APPLIANCE COMPRISING A COMPRESSOR HAVING COMPRESSOR FEET

This application is the U.S. national phase of International Application No. PCT/EP2015/056620 filed 26 Mar. 2015 which designated the U.S. and claims priority to DE Patent Application No. 10 2014 206 718.9 filed 8 Apr. 2014, the entire contents of each of which are hereby incorporated by reference.

The invention relates to a refrigeration appliance, in particular a domestic refrigeration appliance, comprising a compressor having compressor feet, which is supported on a support rail by way of elastic damping bodies that are arranged in openings of the compressor feet, and which is held to said support rail by way of retaining tabs penetrating the damping bodies from below and having securing portions engaging the damping bodies from behind.

In the case of refrigeration appliances, in particular domestic refrigeration appliances such as for example refrigerators, freezers or refrigeration/freezing combinations, it is known for the compressor needed to convey a coolant within a coolant circuit to be mounted in the refrigeration appliance so as to be vibration-damped. Vibration-damped mounting uses the elastic damping bodies to prevent any direct contact between the compressor on the one hand and a carcass of the refrigeration appliance on the other. This reduces any transmission of possible vibrations from the compressor to the carcass of the refrigeration appliance and thus also the development of disruptive noise.

From DE 8627258 U1 an elastic connection to the vibration-damped mounting of a body is known, in particular a compressor module casing on a support rail in the machine compartment of a refrigeration or freezing appliance, wherein the compressor module casing provided with perforated support tabs sits on the support rail by means of elastic bushings that can be snap-fitted into the cutout and is fastened to said support rail by raised lugs punched out of it, which penetrate the bushings from below and fix them with their end portion projecting over the upper end face thereof, in that the end portion of the lug projecting over the bushing is folded so as to abut directly on the end face of the bushing in the manner of a hook, and covers said bushing so that its end at least partially overlaps the end face thereof even in the event of extreme displacement that occurs due to lateral force components acting on the compressor module casing. Installing a compressor in a refrigeration appliance according to the elastic connection known from DE 8627258 U1 requires the use of tools in order to bend the end portions projecting over the bushing. In addition the bending must be done with great care, to ensure the compressor is securely fastened.

The object of the present invention is to provide a refrigeration appliance referred to in the introduction, in particular a domestic refrigeration appliance, in which the compressor can be installed simply and economically, but which nevertheless results in a permanently secure retention of the compressor in the refrigeration appliance.

The object is achieved in that in the case of a refrigeration appliance referred to in the introduction, in particular a domestic refrigeration appliance, it is provided that end portions of the retaining tabs projecting over the damping bodies have insertion means that are designed such that the compressor is or can be installed without any plastic deformation of the retaining tabs.

A major idea of the invention is that during installation the compressor, preferably with damping bodies already inserted in the openings of the compressor feet, can be pushed on and latched to the retaining tabs as far as its end position using the insertion means. The invention is based on the knowledge that the elastic properties of the damping bodies, which are customarily provided only for vibration damping, can be specifically exploited during installation. The damping bodies can be elastically deformed during installation of the compressor such that they can be pushed over the securing portion of the retaining tabs. The securing portion, which like the whole retaining tab does not plastically deform during installation, nevertheless secures the installed compressor, in that the securing portion penetrates the damping body from below and engages it from behind.

Since plastic and preferably also elastic deformation of the retaining tabs can be dispensed with, the result is a high degree of process reliability. Ultimately securing the compressor, i.e. the way the damping bodies are engaged by the securing portion from behind, depends solely on the geometry and material selected, and on the manufacturing precision when producing the retaining tabs, damping bodies and compressor feet, but not on an individual installer.

In addition the installation of the compressor can be performed without tools. The compressor can rather be placed onto the retaining tabs manually by an installer and brought to its end position using the insertion means. This means the installation can be performed more quickly, and the cost of obtaining and maintaining tools that are no longer required is eliminated, as is the risk of injury that always exists when the compressor is installed by bending metal portions.

As the retaining tabs connected to the bottom plate engage the damping bodies from behind, and these in turn support the compressor by way of openings in the compressor feet, further components for securing the compressor can be dispensed with. In particular, there is no need for washers between an upper side of the damping bodies and an underside of the securing portions, nor for retaining forks for securing the retaining tabs in respect of the damping bodies.

Embodiments of the present invention are specified in the subclaims.

According to one embodiment it is provided that the insertion means are in each case formed by at least one insertion chamfer. In a vertical plan view of the retaining tabs the insertion chamfer preferably drops away outward. The insertion chamfer is preferably formed on an upper side of the end portions. Preferably the insertion chamfer extends by way of an opening of the damping bodies, through which the retaining tabs penetrate the damping body in the installed state of the compressor. In particular, the insertion chamfer can extend as far as an outer edge portion of the end portion. It is conceivable for the insertion chamfer to be formed by a flat surface inclined in respect of the horizontal. It is also conceivable for the insertion chamfer to have a curved shape. Where several insertion chamfers, in particular two insertion chamfers, are formed on an end portion, it is conceivable for the insertion chamfers to drop away outward in different directions in a vertical plan view of the retaining tab.

According to one embodiment it is provided that the end portions of the retaining tabs are formed by vertically aligned flat material portions. A height of an end portion, i.e. the vertical extension of a retaining tab measured from an upper edge of the damping bodies, is thus significantly larger than a thickness of the end portion. Compared to a comparably dimensioned but horizontally aligned flat material portion this embodiment permits a higher planar moment of inertia compared to forces acting vertically on the retaining tab, in particular when positioning the compressor or the damping bodies. Where at least one insertion chamfer is provided, this is preferably arranged on an upper side of the flat material blank.

According to one embodiment it is provided that in a vertical plan view of the openings the securing portions project over the edge regions of the openings. As a result the compressor is fastened to the support rail particularly securely, since even if the compressor could disengage itself from the damping bodies due to high vertical forces, it can be retained directly by the securing portions. To further enable the compressor to be installed without plastic deformation and preferably also without elastic deformation of the securing portions, it can be provided that a compressor foot can be displaced counter to a reset force of the damping bodies from a rest position to an installed position and that at least the securing portion of a retaining tab does not engage behind an edge region of the opening in the installed position. In this way the compressor can initially be positioned and latched onto one retaining tab or two retaining tabs and can be pulled toward one other or two other retaining tabs, and by exploiting the elastic deformation of the damping bodies can also be positioned and latched onto said retaining tab or said two retaining tabs. Despite the securing portions engaging the edge regions of the openings from behind, it is also provided in this embodiment that at least after the installation of the compressor the securing portions or other regions of the end portions do not contact the compressor feet, to enable vibrations of the compressor to be decoupled in respect of the support rail.

In principle it can be provided that the retaining tabs have a longitudinal web which is fastened to the support rail with a lug foot, and from which the securing portion protrudes. Preferably the longitudinal web is a flat material portion. Where the end portion is also formed by a flat material portion, both flat material portions preferably lie on one plane, in particular on a vertically upright plane. The securing portion preferably protrudes from the longitudinal web solely within the end portion. Although it is conceivable in principle for the securing portion to protrude from the longitudinal web in two directions, e.g. two opposite directions, installation is simpler, yet the compressor is retained more securely, if it is provided that the securing portion protrudes from the longitudinal web in only one direction.

The compressor can be retained very securely on the support rail if according to one embodiment it is provided that the securing portions of two different retaining tabs protrude from the longitudinal webs in opposite directions. Where for example four retaining tabs are provided, the securing portions can project out from respectively two retaining tabs in a first direction and the securing portions of the two other retaining tabs can project out in a second direction, e.g. opposite to the first one. Where it is alternatively provided that the securing portions of all retaining tabs protrude from the longitudinal webs in the same direction, the installation of the compressor is somewhat simplified.

Although it is in principle sufficient if the securing portions engage the damping bodies from behind in order to prevent vertical disengagement of the damping bodies and thus also of the compressor feet from the retaining tabs, nevertheless in order to suppress possible vertical movements of the compressor completely it is provided according to one embodiment that the securing portions contact the damping bodies. In particular it is possible for the securing portions permanently to exert pressure on the damping bodies. In this way it is possible to prevent minimal movements of the damping bodies potentially caused by vibrations of the compressor, e.g. rotary movements about a vertical axis of the damping bodies that may lead to damage as a result of friction.

To further increase the contact between securing portion and damping body it is provided according to one embodiment that the securing portions have contact arms extending parallel to surfaces of the damping bodies. Preferably precisely one contact arm is provided on each securing portion. These contact arms can be created by bending a portion of the end regions of the retaining tabs and are already present prior to the installation of the compressor. The contact arms too are not deformed plastically, nor preferably elastically, during the installation of the compressor on the support rail, since they form part of the retaining tabs. The contact arms are preferably aligned horizontally, in particular formed by horizontally aligned flat material portions. It is possible in particular for the end portions of the retaining tabs, apart from the contact arms, to be formed by vertically aligned flat material portions, from which the contact arms project out at right angles.

According to one embodiment it is provided that the retaining tabs are integrally formed with the support rail. Preferably the support rail is a sheet metal part. The retaining tabs can be punched out of the support rail, apart from a lug foot, and bent into their final position. Typically the support rail is arranged essentially horizontally, while the retaining tabs project essentially vertically upward from the support rail. The retaining tabs can have reinforcing beads. Preferably the reinforcing beads extend vertically upward from a lug foot, along a longitudinal web of the retaining tabs. More preferably the reinforcing beads terminate prior to the end portion of the retaining tabs, for example the reinforcing beads can extend to approximately half the vertical extent of the retaining tabs from the lug foot.

The compressor feet constitute part of the compressor. Preferably the compressor feet cannot be removed from the compressor without being destroyed. According to one embodiment it is provided that the compressor feet are connected by substance bonding to a compressor housing. In particular, the compressor feet can be welded onto the compressor housing. Typically the compressor has two compressor feet, each with two openings for accommodating the damping bodies. Preferably the openings of the compressor feet, e.g. the four openings, lie on a horizontal plane.

Figure 2:
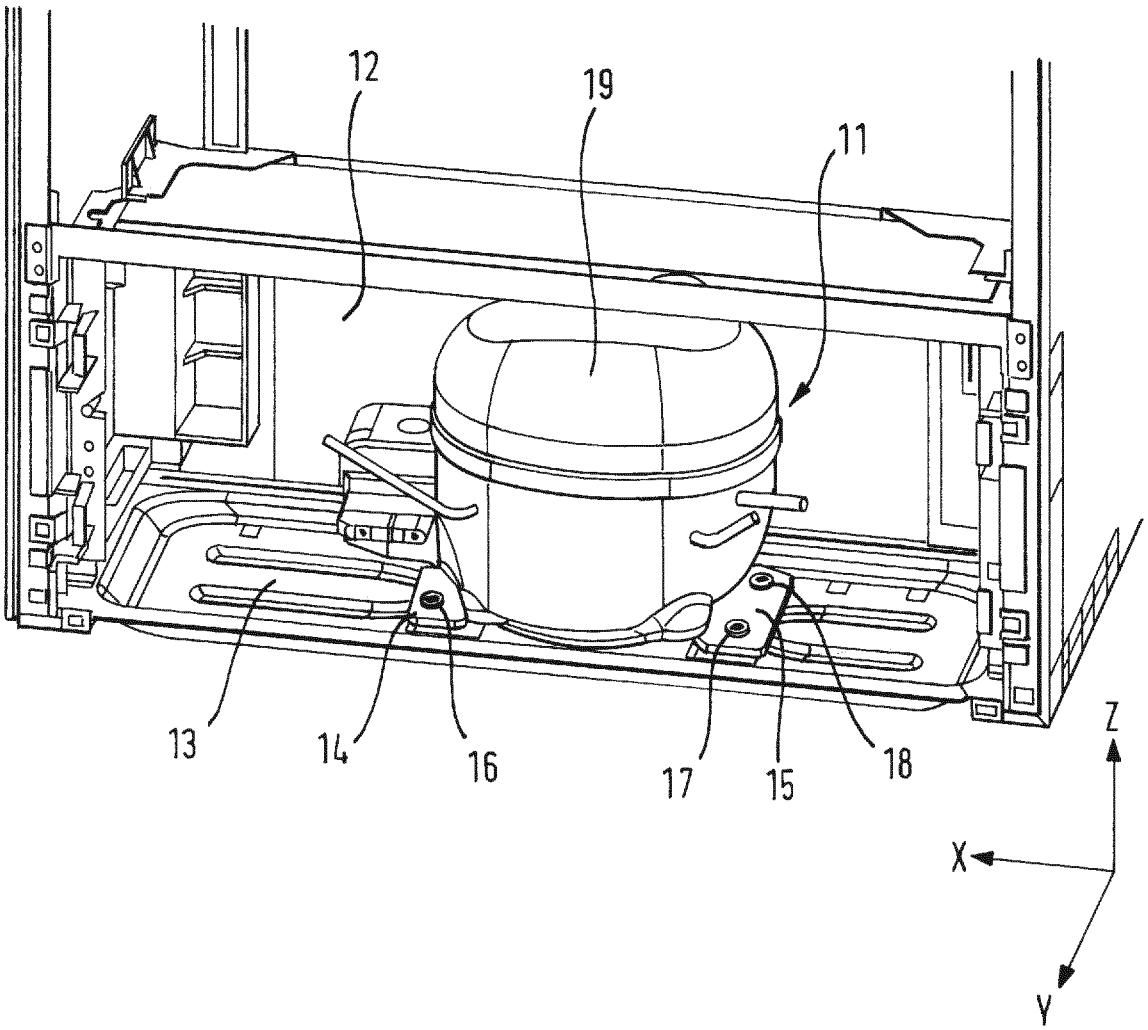
Figure 3:
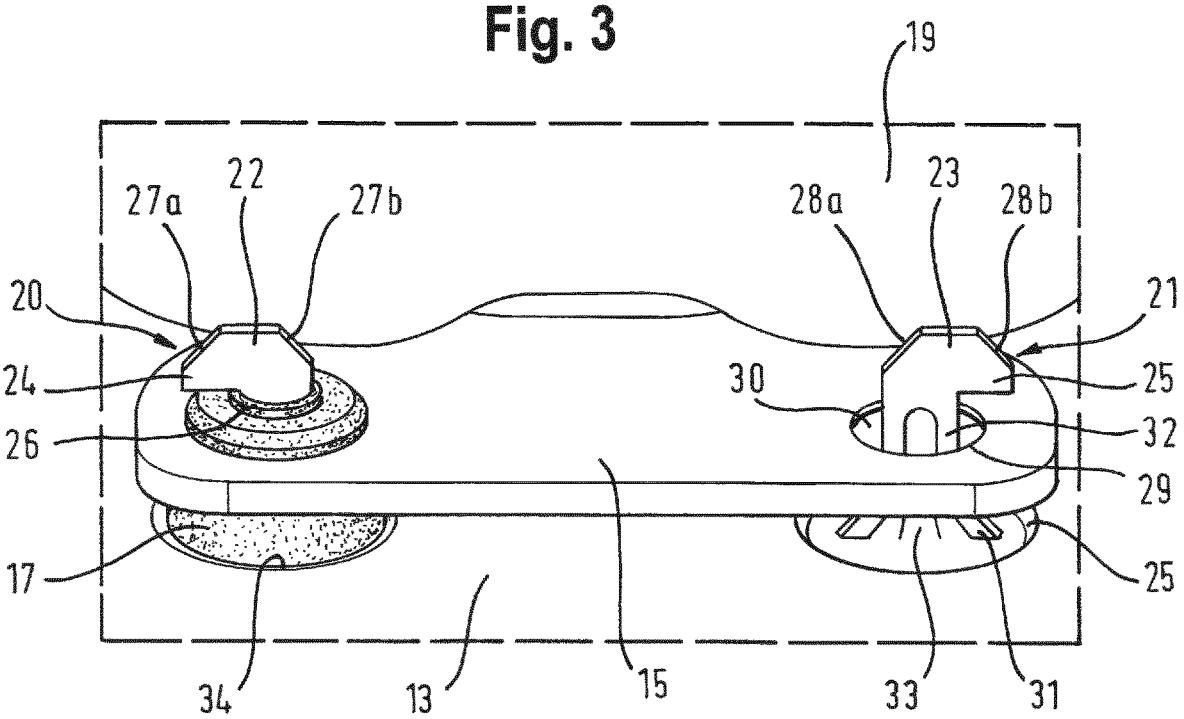
Figure 4:
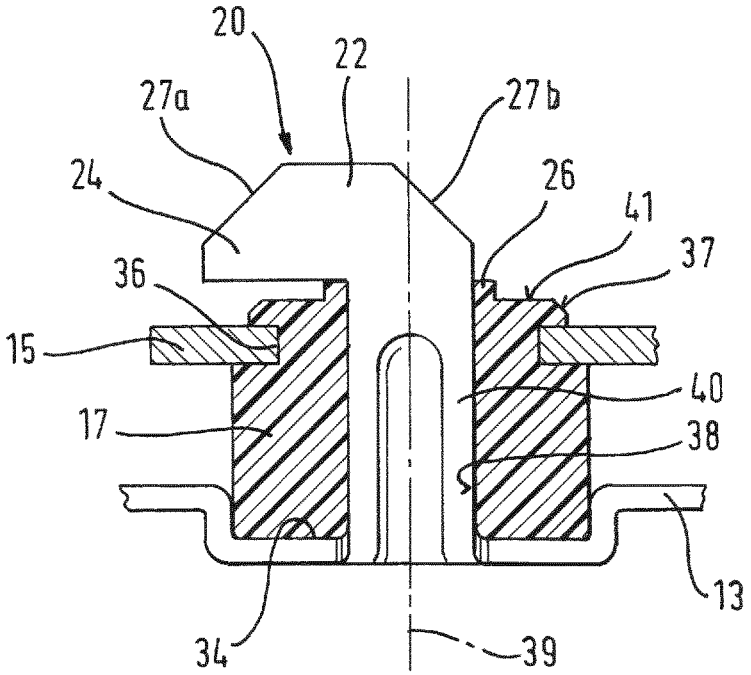
Figure 5:
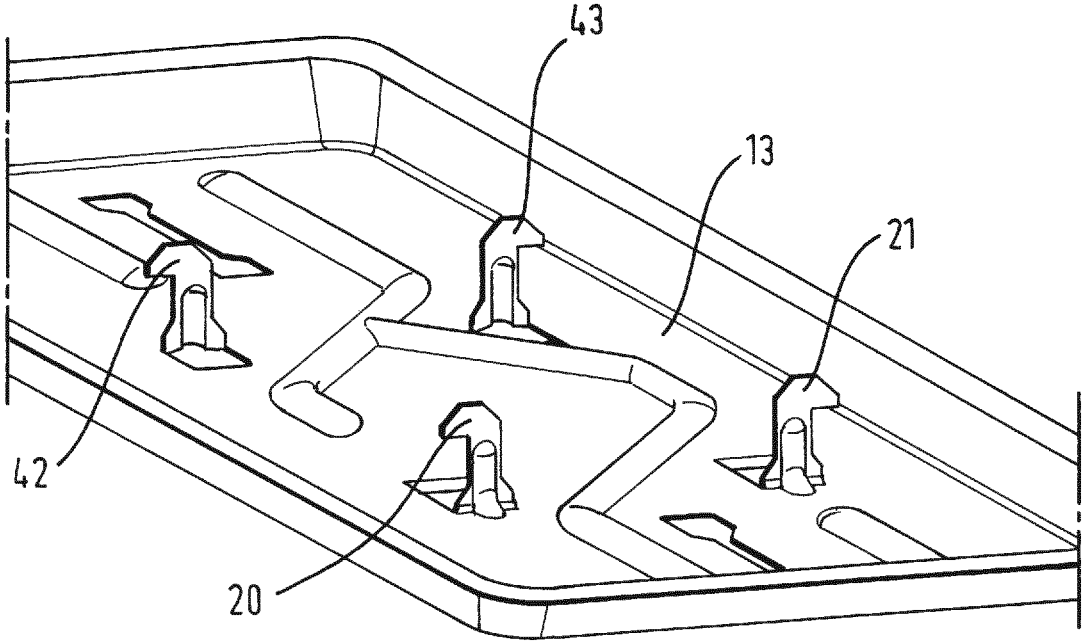
Figure 6:
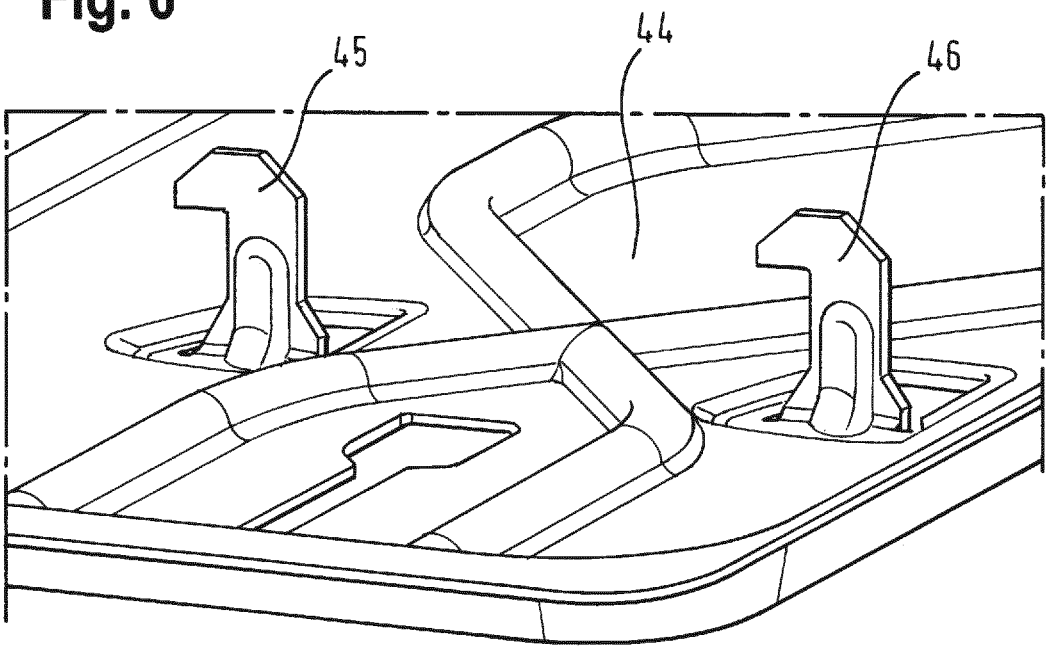
Figure 7:
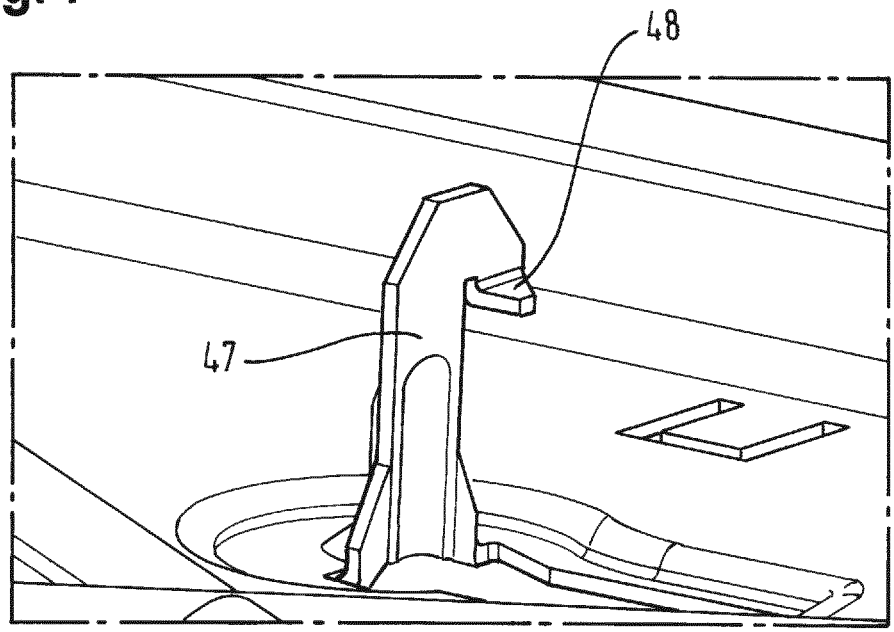

Throughout the disclosure the terms vertical and horizontal always relate to a refrigeration appliance set up for use, in particular a domestic refrigeration appliance. Exemplary embodiments of the present invention are illustrated in the attached figures, in which:

FIG. 1 shows a perspective view of a domestic refrigeration appliance,

FIG. 2 shows a perspective partial view of a rear side of the domestic refrigeration appliance from FIG. 1, FIG. 3 shows a schematic detail view from FIG. 2, FIG. 4 shows a schematic sectional view through a retaining tab, FIG. 5 shows a cutout of the support rail used in FIG. 2, FIG. 6 shows a cutout of a support rail for a second exemplary embodiment of the invention and FIG. 7 shows a retaining tab for a third exemplary embodiment of the invention.

Identical or functionally identical elements are provided with identical reference characters in the figures.

FIG. 1 shows by way of example of an inventive refrigeration appliance a domestic refrigeration appliance 1 in the form of a refrigeration/freezing combination.

A carcass 2 of the domestic refrigeration appliance 1 delimits at least in sections a freezing compartment 3 arranged upward in the vertical direction Z, and a refrigeration compartment 4 arranged vertically therebelow, which can both be closed by separate doors 5, 6 hung on the carcass. Both the freezing compartment 3 and the refrigeration compartment 4 are cooled by way of evaporators 7, 8 which are arranged behind corresponding rear walls 9, 10. The evaporators 7, 8 are connected to a compressor 11. The compressor 11 is arranged in a machine space 12, wherein for illustration purposes in FIG. 1 a part of the wall delimiting the machine space 12 from the refrigeration compartment 4 is cut away.

FIG. 2 shows a perspective partial view of a rear side of the domestic refrigeration appliance 1 from FIG. 1. The compressor 11 is arranged in the machine space 12 on a support rail 13. To this end two compressor feet 14, 15 have openings in which elastic damping bodies 16, 17, 18 are arranged. Arranged in each of the two compressor feet 14, 15 in each case are two damping bodies, wherein in FIG. 2 only three damping bodies 16, 17, 18 are visible. The compressor feet 14, 15 are welded to a compressor housing 19. The support rail 13 is arranged horizontally and is formed as a sheet metal part, in this exemplary embodiment as a press-bent part.

FIG. 3 shows a schematic detail view from FIG. 2 looking toward the compressor foot 15. For illustration purposes the damping body necessary for fastening the compressor to the support rail 13 is not illustrated on the right-hand side.

Both the retaining tabs 20, 21 are integrally formed with the support rail 13 and project vertically upward from the horizontally arranged support rail 13. The support rail 13 with the retaining tabs 20, 21 was manufactured as a press-bent part from a thin metal sheet.

End portions 22, 23 of the retaining tabs 20, 21, in other words those portions of the retaining tabs 20, 21 which project vertically upward over the damping bodies 17, are formed by vertically aligned flat material portions. The end portions 22, 23 have securing portions 24, 25 which engage the damping bodies 17 from behind. A securing portion 24 abuts a collar 26 of the damping body 17 with a surface directed vertically downward.

Two insertion chamfers 27*a*, 27*b*, 28*a*, 28*b* are provided as insertion means at each end portion 22, 23 in each case, so that the compressor 11 can be installed without any plastic deformation of the retaining tabs 20, 21. The insertion chamfers 27*a*, 27*b*, 28*a*, 28*b* are embodied as inclined planes of the vertically aligned flat material portion and drop away outward.

As is apparent on the basis of the retaining tab 21 on the right in FIG. 3, the securing portion 25 projects out beyond an edge 29 of the opening 30 of the compressor foot, in order additionally to secure the compressor 11 against vertical disengagement. However, the securing portion 25 projects over the edge 29 only to the extent that in the case of a compressor 11 which is displaced counter to the reset forces of the damping elements 17 from the rest position of the compressor 11 illustrated in FIG. 3 to an installed position, the securing portion 25 no longer projects over the edge 29. In the illustration according to FIG. 3 the compressor 11 cannot be displaced to the right for this.

The retaining tab 21 is connected to the support rail 13 by way of a lug foot 31 and has a longitudinal web 32. Starting at the lug foot 31 a reinforcing bead 33 is formed on the retaining tab 21, and runs vertically over half the vertical extent of the retaining tab 21. The securing portion 25 protrudes from the longitudinal web 32. The two securing portions 24, 25 protrude in different, namely opposite, directions. The retaining tabs 20, 21 are surrounded by bowl-like depressions 34, 35, which prevent displacement of the damping bodies 17 in a horizontal plane.

FIG. 4 shows a schematic sectional view through the retaining tab 20 along a vertically aligned plane of intersection.

The rotationally symmetrical damping body 17 has a constriction 36, in which the compressor foot 15 is held above its opening. For this the damping body 17 can be pressed through the opening by means of a rotationally symmetrical chamfer 37. Any disengagement of the compressor foot 15 in the vertical direction, starting from the rest position illustrated in FIG. 4, is thus initially prevented solely by the damping body 17. Only if very high vertically upward forces are exerted on the compressor foot 15, e.g. if an improper attempt is made to disassemble the compressor 11, the compressor foot 15 could slip out of the constriction 36. In this case the securing portion 24 projecting over the edge of the opening would contact the compressor foot 15 and prevent a further vertical disengagement of the compressor 11.

The damping body 17 has an opening 38 which is arranged concentrically to the rotational axis of symmetry 39 and takes the form of a through-hole. An internal diameter of the opening 38 is dimensioned such that the longitudinal web 40 of the retaining tab 20 is contacted.

In the exemplary embodiment shown the damping body 17 contacts the securing portion 24 solely by way of the collar 26. If a contact arm protruding at right angles from the securing portion 24 were arranged on said securing portion 24 (see FIG. 7), the contact arm could abut an annular contact surface 41.

FIG. 5 shows a cutout of the support rail 13 from the exemplary embodiment according to FIG. 1 to 4 with all four retaining tabs 20, 21, 42, 43. In each case two retaining tabs, which interact with a compressor foot, i.e. retaining tabs 20 and 21 as well as retaining tabs 42 and 43, have securing portions which are aligned in opposite directions.

FIG. 6 shows a cutout of a support rail 44 for use in an inventive refrigeration appliance according to a second exemplary embodiment. Unlike the support rail 13 from FIG. 5 the retaining tabs 45, 46, which interact with a compressor foot, have securing portions which are aligned in the same direction.

FIG. 7 shows a retaining tab 47 for use in an inventive refrigeration appliance according to a third exemplary embodiment. The securing portion has a contact arm 48 angled away therefrom and extending horizontally.

| LIST OF REFERENCE CHARACTERS | |
|---|---|
| 1 | Domestic refrigeration appliance |
| 2 | Carcass |
| 3 | Freezing compartment |
| 4 | Refrigeration compartment |
| 5 | Door |
| 6 | Door |
| 7 | Evaporators |
| 8 | Evaporators |
| 9 | Rear wall |
| 10 | Rear wall |
| 11 | Compressor |
| 12 | Machine space |
| 13 | Support rail |

-continued

| LIST OF REFERENCE CHARACTERS | |
|---|---|
| 14 | Compressor foot |
| 15 | Compressor foot |
| 16 | Damping body |
| 17 | Damping body |
| 18 | Damping body |
| 19 | Compressor housing |
| 20 | Retaining tab |
| 21 | Retaining tab |
| 22 | End portion |
| 23 | End portion |
| 24 | Securing portion |
| 25 | Securing portion |
| 26 | Collar |
| 27a | Insertion chamfer |
| 27b | Insertion chamfer |
| 28a | Insertion chamfer |
| 28b | Insertion chamfer |
| 29 | Edge |
| 30 | Opening |
| 31 | Lug foot |
| 32 | Longitudinal web |
| 33 | Reinforcing bead |
| 34 | Depression |
| 35 | Depression |
| 36 | Constriction |
| 37 | Chamfer |
| 38 | Opening |
| 39 | Rotational axis of symmetry |
| 40 | Longitudinal web |
| 41 | Contact surface |
| 42 | Retaining tab |
| 43 | Retaining tab |
| 44 | Support rail |
| 45 | Retaining tab |
| 46 | Retaining tab |
| 47 | Retaining tab |
| 48 | Contact arms |

The invention claimed is:

1. A domestic appliance, comprising a compressor having compressor feet, which is supported on a support rail by way of elastic damping bodies that are arranged in openings of the compressor feet, and which is held to said support rail by way of retaining tabs, the retaining tabs having end portions with securing portions dimensioned and configured to pass through the damping bodies and the openings of the compressor feet, the securing portions directly engaging top surfaces of the damping bodies from behind, wherein the end portions of the retaining tabs are configured to project over the damping bodies without any plastic deformation of the retaining tabs after the end portions are passed through the damping bodies and the openings of the compressor feet, wherein the retaining tabs and the support rail form a one-piece construction.

2. The domestic appliance as claimed in claim 1, wherein each of the end portions includes at least one insertion chamfer.

3. The domestic appliance as claimed in claim 1, wherein the end portions of the retaining tabs are press-bent from the support rail, to form vertically oriented flat material portions.

4. The domestic appliance as claimed in claim 1, wherein the securing portions of two different retaining tabs protrude in opposite directions from longitudinal webs.

5. The domestic appliance as claimed in claim 1, wherein the securing portions of all retaining tabs protrude in the same direction from longitudinal webs.

6. The domestic appliance as claimed in claim 1, wherein the securing portions contact the damping bodies.

7. The domestic appliance as claimed in claim 6, wherein the securing portions have contact arms extending parallel to surfaces of the damping bodies.

8. The domestic appliance as claimed in claim 1, wherein the securing portions do not contact the compressor feet.

9. The domestic appliance as claimed in claim 1, wherein the compressor feet are connected by substance bonding to a compressor housing.

10. The domestic appliance as claimed in claim 1, wherein the support rail includes depressions to receive respective ones of said damping bodies, the retaining tabs extending from the respective depressions.

11. The domestic appliance as claimed in claim 1, wherein each said retaining tab has an asymmetric shape as viewed along a longitudinal axis of the respective damping body.

12. The domestic appliance as claimed in claim 1, wherein the damping bodies includes a top portion including a collar that projects from a relatively recessed portion, the retaining tabs directly contacting the collar and being spaced from the recessed portion.

13. The domestic appliance as claimed in claim 1, wherein each said end portion extends radially outward of a diameter of the respective damping body.

14. A domestic appliance comprising a compressor having compressor feet, which is supported on a support rail by way of elastic damping bodies that are arranged in openings of the compressor feet, the compressor feet having rim regions that define the openings, the compressor being held to said support rail by way of retaining tabs, the retaining tabs having end portions with securing portions dimensioned and configured to pass through the damping bodies and the openings of the compressor feet, the securing portions directly engaging top surfaces of the damping bodies from behind, wherein the end portions of the retaining tabs are configured to project over the damping bodies, wherein the securing portions, after passing through the damping bodies and the openings of the compressor feet, project over the rim regions of the compressor feet, as seen in a plan view.

15. The domestic appliance as claimed in claim 14, wherein at least one of the compressor feet can be displaced counter to a reset force of the damping bodies from a rest position to an installed position and wherein at least the securing portion of a retaining tab does not engage the edge region of the opening in the installed position from behind.

16. The domestic appliance as claimed in claim 14, wherein the support rail includes depressions to receive respective ones of said damping bodies, the retaining tabs extending from the respective depressions.

17. The domestic appliance as claimed in claim 14, wherein each said retaining tab has an asymmetric shape as viewed along a longitudinal axis of the respective damping body.

18. The domestic appliance as claimed in claim 14, wherein each said end portion extends radially outward of a diameter of the respective damping body.

* * * * *